US008280282B2

(12) United States Patent
Blanck et al.

(10) Patent No.: US 8,280,282 B2
(45) Date of Patent: Oct. 2, 2012

(54) ASSEMBLY FOR ACHIEVING UNIFORM DOCTOR BLADE FORCE

(75) Inventors: Thomas Wilbur Blanck, Lexington, KY (US); Jarrett Clark Gayne, Lexington, KY (US); Brad Edward Mattingly, Lexington, KY (US); Robert Christopher Sbert, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 638 days.

(21) Appl. No.: 11/950,060

(22) Filed: Dec. 4, 2007

(65) Prior Publication Data

US 2009/0142108 A1 Jun. 4, 2009

(51) Int. Cl.
*G03G 15/08* (2006.01)

(52) U.S. Cl. ..... 399/284

(58) Field of Classification Search ..... 399/284, 399/350, 351, 274

See application file for complete search history.

(56) References Cited

U.S. PATENT DOCUMENTS

| | | | | |
|---|---|---|---|---|
| 2,477,339 | A * | 7/1949 | Ljungquist | |
| 2,487,409 | A | 11/1949 | Baker | |
| 3,229,662 | A | 1/1966 | Means | |
| 4,803,752 | A * | 2/1989 | Kasama | |
| 5,177,323 | A * | 1/1993 | Kohyama | |
| 5,424,817 | A * | 6/1995 | Imamiya et al. | |
| 5,489,974 | A * | 2/1996 | Kamaji et al. | 399/285 |
| 5,768,676 | A * | 6/1998 | Hokari et al. | |
| 5,819,145 | A | 10/1998 | Tanaka et al. | |
| 6,070,039 | A | 5/2000 | Yamaki et al. | |
| 6,282,395 | B1 * | 8/2001 | Nittani et al. | 399/284 |
| 6,438,347 | B2 * | 8/2002 | Nittani et al. | 399/284 |
| 6,603,944 | B2 | 8/2003 | Tatsumi | |
| 7,082,280 | B2 | 7/2006 | Kim | |
| 2005/0047828 | A1 * | 3/2005 | Kawai | |
| 2005/0074262 | A1 * | 4/2005 | Kamimura | 399/284 |
| 2006/0140683 | A1 * | 6/2006 | Takami | 399/284 |

OTHER PUBLICATIONS

International Search Report and Written Opinion of the International Searching Authority dated Feb. 9, 2009 for PCT Application No. PCT/US2008/085503 which claims priority to the present application.

* cited by examiner

*Primary Examiner* — Walter L Lindsay, Jr.
*Assistant Examiner* — Milton Gonzalez
(74) *Attorney, Agent, or Firm* — John Victor Pezdek; Justin M Tromp

(57) ABSTRACT

A doctor blade assembly for an electrophotographic printer comprises a first bracket having a first width dimension and a first height dimension, a second bracket having a second width dimension and a second height dimension, a doctor blade disposed between the front bracket and the rear bracket, the doctor blade having a cantilever length, the cantilever length varying from a first length at a first location and a second length at a second location moving along the width dimensions.

12 Claims, 10 Drawing Sheets

ASSEMBLY FOR ACHIEVING UNIFORM DOCTOR BLADE FORCE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates to a doctor blade assembly, and more specifically relates to an assembly for providing uniform force on a developer roll in order to provide consistent darkness in an electrophotographic (laser) printed image across a page width.

2. Description of the Related Art

Laser printers utilize a light beam which is focused to expose a discrete portion of a photoreceptive or image transfer drum in a further attempt to attract printing toner to these discrete portions.

One component of a laser printer is the photoreceptive drum assembly. This photoreceptive drum assembly is made out of highly photoconductive material that is discharged by light photons typically embodied by a laser. Initially, the drum is given a charge by a charge roller. As the photoreceptive drum revolves, the printer shines a laser beam across the surface to discharge certain points. In this way, the laser "draws" the letters and images to be printed as a pattern of electrical charges—an electrostatic latent image. The system can also work with either a more positively charged electrostatic latent image on more negatively charged background or a more negatively charged electrostatic latent image on a more positively charge background.

The printer's laser or laser scanning assembly draws the image to be printed on the photoreceptive drum. The traditional laser scanning assembly may include a laser, a movable mirror and a lens. The laser receives the image data defined by pixels that make up the text and images one horizontal line at a time. As the beam moves across the drum, the laser emits a pulse of light for every pixel to be printed. Typically, the laser doesn't actually move the beam. Instead, the laser reflects the light beam off of a movable mirror. As the mirror moves, the light beam passes through a series of lenses. This system compensates for the image distortion caused by the varying distance between the mirror and points along the drum. The laser assembly moves in only one plane, horizontally. After each horizontal scan, the printer rotates the photoreceptor drum a preselected distance so the laser assembly can draw the next line. A print controller synchronizes this activity. The process of forming the light image on the photoreceptive drum discharges those areas where the image is formed.

When the toner becomes electrostatically charged, the toner is attracted to exposed portions of the image transfer drum. After the data image pattern is set, charged toner is supplied to the photoconductive drum. The toner is charged so that it is attracted to the areas discharged by the laser beam and repelled by the charge on the undischarged areas.

Because it is oppositely charged, the toner is attracted to and clings to the discharged areas of the drum, but not to the similarly charged "background" portions of the photoconductive drum. Toner is an electrostatically charged powder with two main ingredients, pigment and plastic. The pigment provides the coloring, such as black in a monochrome printer, that forms the text and images. This pigment is blended with plastic particles, so the toner will melt when passing through the heat of a fuser assembly. The toner is stored in the toner cartridge housing, a small container built into a removable casing. The printer gathers the toner from a sump within the housing and supplies it to a developer unit or assembly using paddles and transfer rollers. The developer roll is a charged rotating roller, typically with a conductive metal shaft and a polymeric conductive coating, which receives toner from a toner adder roll positioned adjacent the developer roll. Due to the charge, the developer roll collects the more oppositively charged toner particles from the toner adder roll. A doctor blade assembly engages the developer roll to provide a consistent coating of toner along the length and surface of developer roll, by scraping or "doctoring" excess toner from the developer roll. The doctor blade may also induce a charge on the developer roll. In turn, this provides a consistent coating of toner to the photoconductive drum. When the coating of toner on the developer roll is inconsistent, too thick, too thin or bare, coating of the photoconductive drum is inconsistent and the level of darkness of the printed image may vary unintentionally, which is considered a print defect.

The electrostatic image on the photoconductive drum is charged so that the toner particles move from the developer roll onto the latent image on the photoconductive drum. With the image data toner pattern on the photoconductive drum, the drum engages a sheet of paper or media moving adjacent thereto. Before the paper moves adjacent to the drum, the medium or paper is given a negative charge by the transfer corona wire or a charged roller. This charge is stronger than the charge of the electrostatic image, so the paper can pull the toner powder away from the surface of the photoconductive drum. When a medium, printing paper, passes beneath the rotating photoconductive drum, the toner is transferred to the medium. Since it is moving at the same speed as the drum, the paper picks up the image pattern exactly. To keep the paper from clinging to the drum, it can be discharged immediately after picking up the toner.

Finally, the paper moves through the fuser assembly, which may be embodied by a pair of rollers, one or both of which can be heated. As the paper passes through these rollers, the toner melts, permanently fusing with the fibers in the paper. The paper next feeds to the output tray.

One problem with existing doctor blade assemblies is that of providing a consistent force across the axial length of the developer roll. As previously mentioned, when the coating of toner on the developer roll is not consistent, the printed image quality may suffer. Analysis of the connections of the doctor blade assembly and the developer housing has resulted in the determination that the connection provides unintended stiffening of the doctor blade in the area of these connections. A stiffer doctor blade in these areas results in less toner applied to the developer roll in that corresponding area and therefore less toner being able to be transferred to the drum in the corresponding area and subsequently a lighter image. The connections of the doctor blade assembly to the developer are located at ends of the doctor blade assembly; therefore, image darkness has suffered near ends of the blade assembly. It is preferable to have images of consistent darkness across the width of media.

SUMMARY OF THE INVENTION

A doctor blade assembly for an electrophotographic printer comprises a first bracket having a first width dimension and a first height dimension, a second bracket having a second width dimension and a second height dimension, a doctor blade disposed between the first and second bracket, the doctor blade having a cantilever length, the cantilever length varying from a first length at a first location and a second length at a second location moving along said width dimensions. The doctor blade assembly further comprises a spacer disposed near each end of the doctor blade between one of the first bracket or the second bracket and the doctor blade. The doctor blade assembly wherein one of the first bracket or the second bracket comprises a radiused lower edge.

A doctor blade assembly comprises a first bracket having a first leg of a first width defined between a first end and a second end, a second bracket having a second leg having a second width substantially equal to the first width, a doctor blade disposed between the first and second brackets, the doctor blade connected to the first bracket and the second bracket near the first and second ends of the first bracket and the second bracket wherein the doctor blade has a cantilever length which is longer near the first and second ends than between the ends. The doctor blade assembly further comprises a spacer disposed between the doctor blade and one of the first bracket and the second bracket. The first bracket or the second bracket has a contoured lower edge for providing a variable cantilever length of the doctor blade. The doctor blade assembly further comprises a developer housing connected to the doctor blade assembly. The doctor blade assembly further comprises an assembly screw near each of the first and second ends of the first and second brackets, respectively wherein the assembly screw connects the doctor blade assembly to the developer housing. The doctor blade assembly further comprises at least one clamping screw connecting the first bracket, the second bracket and the doctor blade. The doctor blade assembly further comprises providing a force on the doctor blade with the spacer disposed on a side of the doctor blade opposite a direction of the force.

A doctor blade assembly comprises a first bracket having a width and a length, a second bracket substantially parallel to the first bracket, a doctor blade disposed between the first blade and the second blade, a spacer disposed between said doctor blade and one of the first bracket and the second bracket, the doctor blade having a tapering cantilever distance between the ends of the first bracket toward a substantially central position in the width dimension. The doctor blade assembly engages a developer roll. The spacer is positioned on a side of the doctor blade opposite engagement between the doctor blade and the developer roll. The doctor blade assembly further comprises an assembly fastener near each end of the doctor blade assembly for connecting the assembly to a developer housing. The doctor blade assembly further comprises clamping fasteners positioned inwardly of the assembly fasteners. One of the first and second brackets further comprises a lower edge having a curvature from a first end to a second end.

BRIEF DESCRIPTION OF THE DRAWINGS

The aforementioned features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
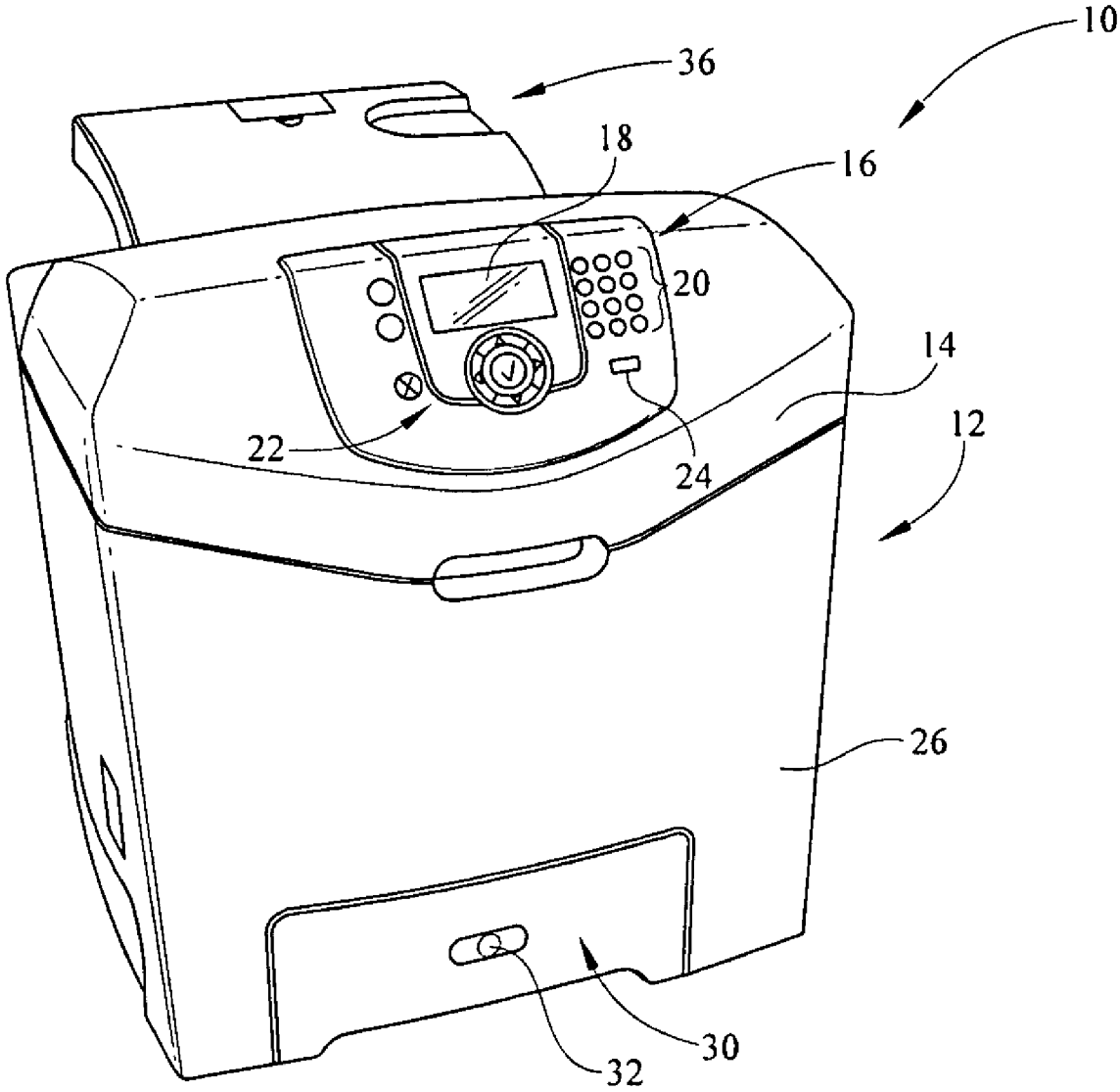
FIG. 1 depicts a perspective view of an exemplary laser or electrophotographic printer.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As described in subsequent paragraphs, the specific mechanical configurations illustrated in the drawings are intended to exemplify embodiments of the invention and other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may be an electrophotographic printer, and any other suitable print formats. The term button as used herein means any component, whether a physical component or graphic user interface icon, that is engaged to initiate output. The term media and paper may be used interchangeably herein and may include plain paper, glossy photo paper, coated paper, card stock, index cards, labels, envelopes, transparency, MYLAR, fabric, or other printable materials. The term operations panel, as used herein, means an interactive display allowing for menu display, menu selections, image viewing, editing of images, correction of error conditions and other operations and control functions. The term peripheral may include a single function or multi-function, or all-in-one, device which may be connected to a host computer, network connected or may be a stand-alone, which is a device which may function independently of any host computer.

The exemplary embodiments described herein provide doctor blade assemblies which provide a uniform force along the axial distance of a developer roll so that toner is uniformly delivered to an image transfer or photoreceptive drum.

Figure 2:
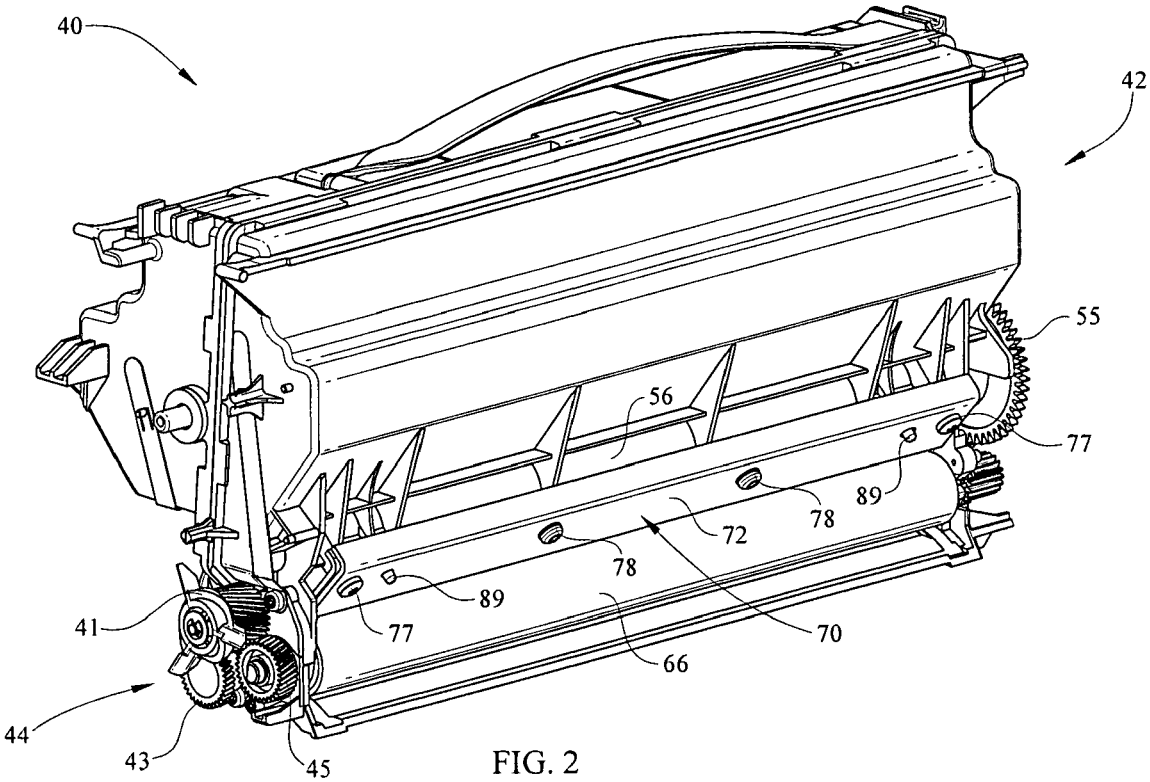
FIG. 2 depicts a perspective view of a developer assembly.

Referring now to FIG. 1, a perspective view of a laser printer 10 is depicted in perspective view. Although, the peripheral device is depicted, one skilled in the art should realize that the present design may alternatively be used with an all-in-one device, copier, fax, stand-along device or the like having an electrophotographic (laser) print engine. The laser printer 10 comprises a housing 12 including a primary toner access door 14 positioned on the front of the housing 12. The housing 12 generally comprises a front surface, first and second side surfaces, a rear surface (not shown) and a bottom surface to enclose the laser printer operating mechanisms. On the front of the housing 12, the toner access door 14 is pivotally mounted to allow opening and access for installation or removal of a developer assembly 40 (FIG. 2). The front panel of the primary access door 14 comprises an operations panel 16 which includes a display 18, an alpha numeric keypad 20, a plurality of selection buttons 22, as well as a flash memory slot 24. The operations panel 16 is in electronic communication with a controller (not shown), which may be embodied by one or more microprocessors, microcontrollers, or ASICs in order to operate the laser printer 10. Beneath the primary access door 14 is a secondary access door 26 which allows access to additional developer assemblies, such as in the case where the laser printer is printing in both monochrome and color. For example, three additional assemblies may be utilized to provide the color printing comprising the toner colors cyan, yellow or magenta, although other colors may be utilized.

Beneath the access doors 14, 26 is an input tray access door 30. When the input tray access door 30 is opened with a release 32, an input tray (not shown) is accessible to load the printer 10 with media. The input tray may hold a stack of media for printing and further defines a starting point of a media feedpath (not shown) extending from the media input tray to a media output tray 36. The media feedpath may be a duplex feedpath or a simplex feedpath. The media output tray 36 is located on top of the housing 12 and generally extends rearwardly to store printed media processed by the laser printer 10.

Referring now to FIG. 2, a developer assembly 40 is depicted in perspective view. Although shown and described as two portions, the housing may be embodied by one or more parts. The exemplary developer housing is defined by a toner upper housing 42 and a toner lower housing 44 in feeding communication with the upper housing 42. At the lower left hand side of the illustrated developer assembly 40, a helical developer drive gear 41, including input wings, receives a rotational input to drive a toner adder roll gear 43, and a developer roll gear 45. The toner adder roll 64 (see FIG. 3) supplies toner to a developer roll 66. The developer roll 66 is driven by rotation of the developer roll gear 45 which receives input from the developer drive gear 41. A metering device 56 is disposed between the upper housing 42 and the lower housing 44, and is driven by a metering device gear 55 receiving rotation force from a gear positioned on the end of the developer roll 66 or the toner adder roll 64. Adjacent to the metering area between the upper housing 42 and lower housing 44, is a doctor blade assembly 70. The doctor blade assembly 70 is positioned at an intersecting angle with respect to the surface of the developer roll 66 (see FIG. 3). The doctor blade assembly 70 engages a portion of the surface of developer roll 66 along its axial length, to provide a consistent thickness or coating of toner on the surface of the developer roll 66 across its axial length. The coating of toner is transferred from the developer roll 66 to a photoconductive drum (not shown) for printing. The doctor blade assembly 70 is aligned with locating pins 89 extending from the developer assembly 40, and fastened by doctor blade assembly screws 77 to the developer assembly 40.

Figure 3:
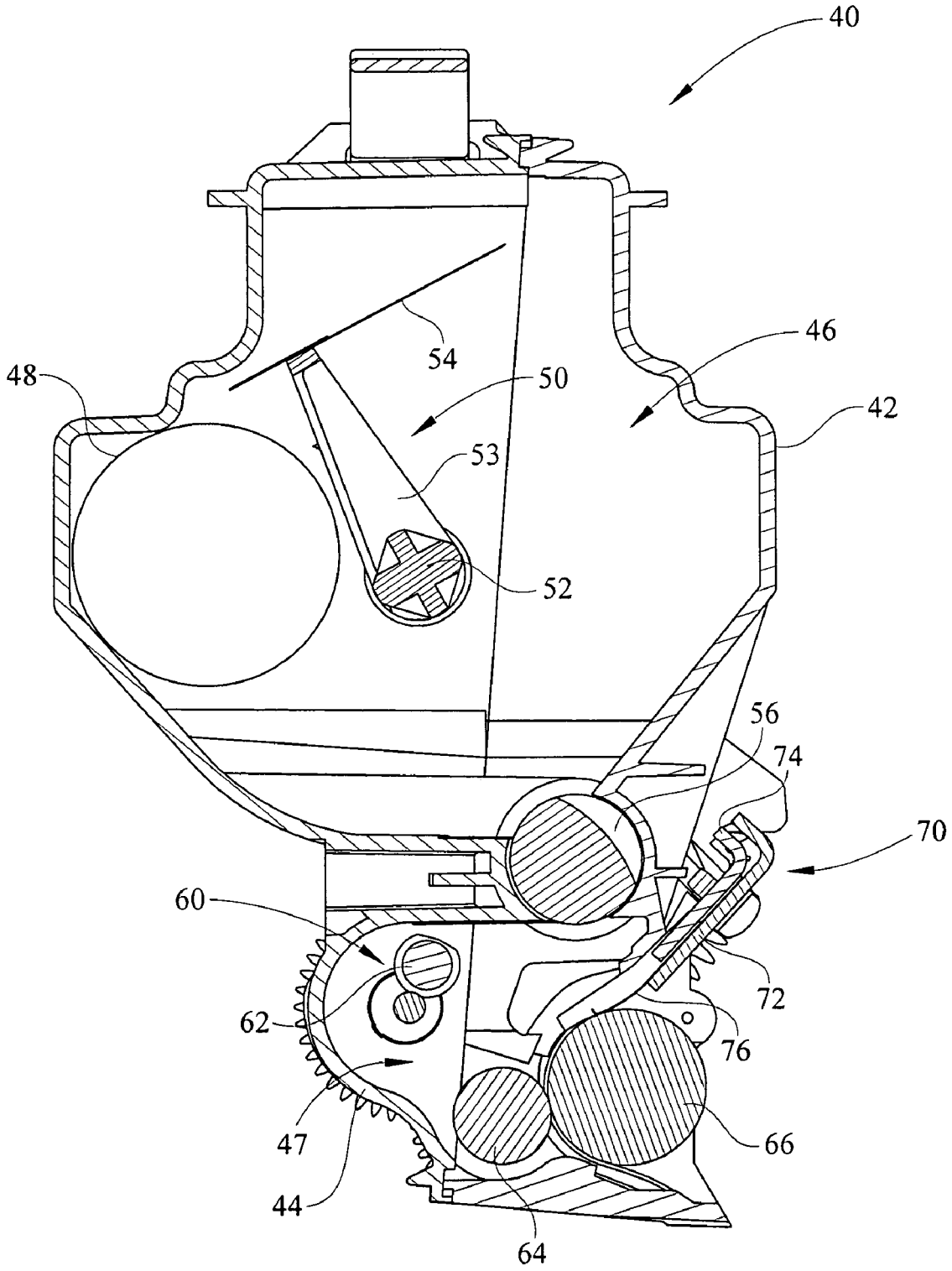
FIG. 3 depicts a side-sectional view of the developer assembly of FIG. 2.

Referring to FIG. 3, the developer assembly 40 is shown in a side section, depicting the internal components of the assembly 40. The upper housing 42 defines a cavity or upper toner sump 46, wherein toner is stored for use. The toner may be formed of pigment and plastic, as previously described. Within the upper housing 42 is a paddle 50 which moves and agitates toner located therein and inhibits clumping. The paddle 50 comprises a paddle shaft 52 which is pivotally mounted within the upper housing 42 for rotation. Extending from the shaft 52, is a paddle arm 53 which rotates with the rotation of the paddle shaft 52. The paddle arm 53 may be integrally formed with the shaft 52, or alternatively may be connected to the shaft 52, as will be understood by one skilled in the art. At the distal end of the arm 53 opposite the paddle shaft 52 is a skirt 54 which engages the toner for agitation thereof. The skirt 54 may be formed of a polyethylene terephthalatepolyester (PET) material, also known as MYLAR or other resilient plastic. Also shown within the upper housing 42 is an aperture 48 which operates as a toner fill hole 48 for loading the upper sump 46 with toner during manufacture.

At a lowermost position of the upper housing 42 in feeding communication between the upper sump 46 and lower sump 47 is the metering device 56. In cross section, the metering device 56 is substantially circular in shape and receives toner through an opening in the housing 42. The metering device 56 is depicted in FIG. 2 connecting to the metering device gear 55 for rotation when the lower toner sump 47 within the lower housing 44 requires additional toner from the upper sump 46. Within the lower housing 44 is a toner level sensing paddle 60. The paddle 60 has a rotation shaft about which a weighted portion 62 moves. The weighted portion 62 falls through a distance corresponding to the height and amount of toner in the lower sump 47. When the toner amount within the lower sump 47 drops below a certain level, the weighted portion 62 is able to rotate downward to a preselected position corresponding to this level signaling for the rotation of the metering device to provide additional toner to the lower sump 47 from the upper sump 46.

Also located within the lower housing 44 is a toner adder roll 64, which is connected to and driven by the toner adder roll gear 43 (see FIG. 2). The toner adder roll 64 is near the lower portion of the toner sump 47, to provide an appropriate coating of toner on the adder roll 64. The toner adder roll 64 engages the developer roll 66 which rotates in a clockwise direction as shown in FIG. 3. The toner adder roll 64 provides toner for coating of the developer roll 66, which subsequently transfers toner to a photoconductive image drum (not shown).

Above the developer roll 66 is a doctor blade assembly 70 comprising a front bracket 72, a rear bracket 74 and a doctor blade 76 sandwiched between the front and rear brackets 72, 74. The doctor blade 76 engages the developer roll 66 during rotation, so as to place a force on the developer roll 66 and provide a consistent level of toner across the axial length of the developer roll 66. Alternatively stated, excess toner is scraped from the developer roll 66 during rotation to maintain a consistent coating level on the developer roll 66.

Figure 4:
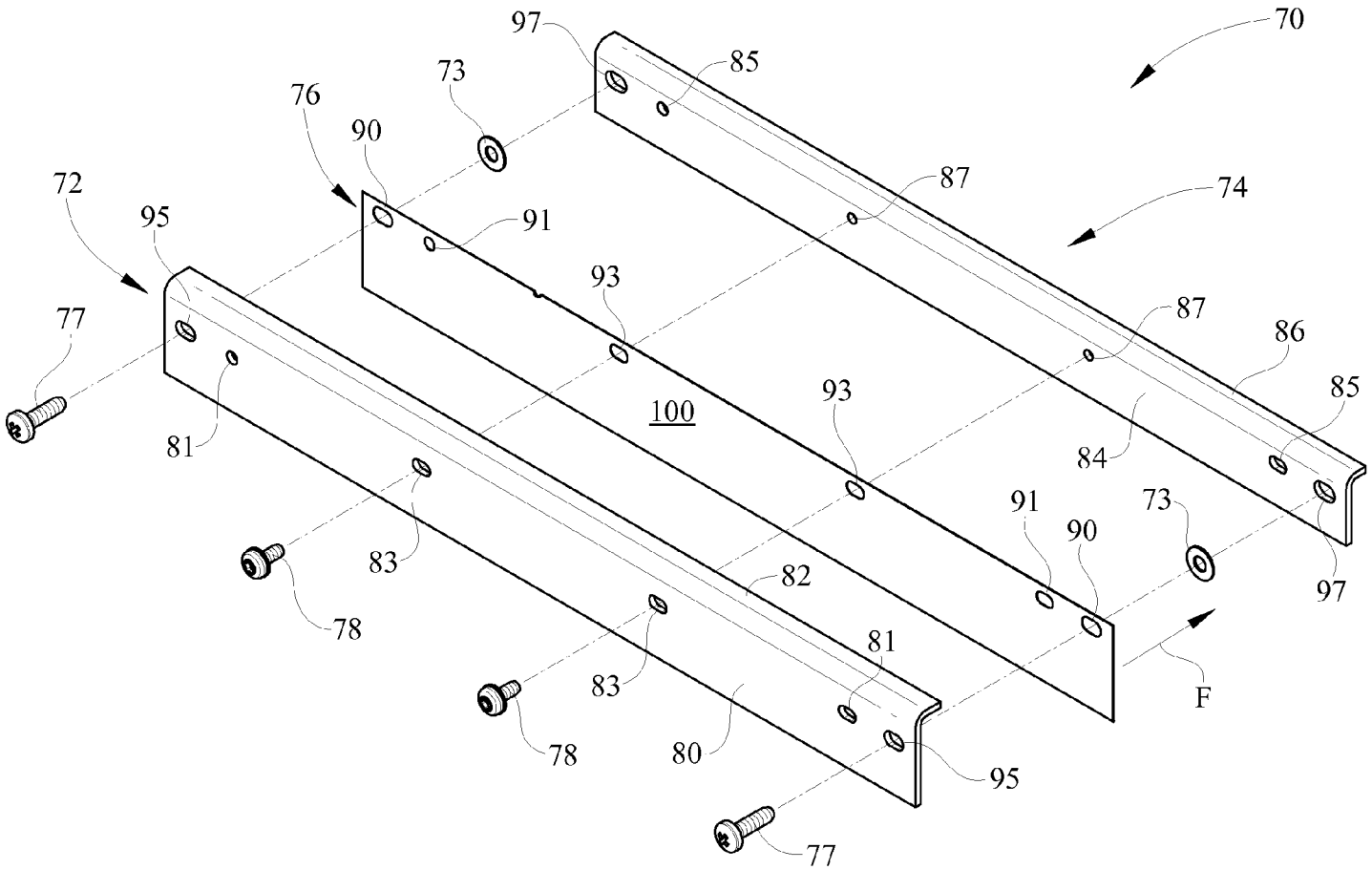
FIG. 4 depicts a front exploded perspective view of a doctor blade assembly according to an embodiment wherein a spacer is disposed between the doctor blade and a rear bracket.
Figure 5:
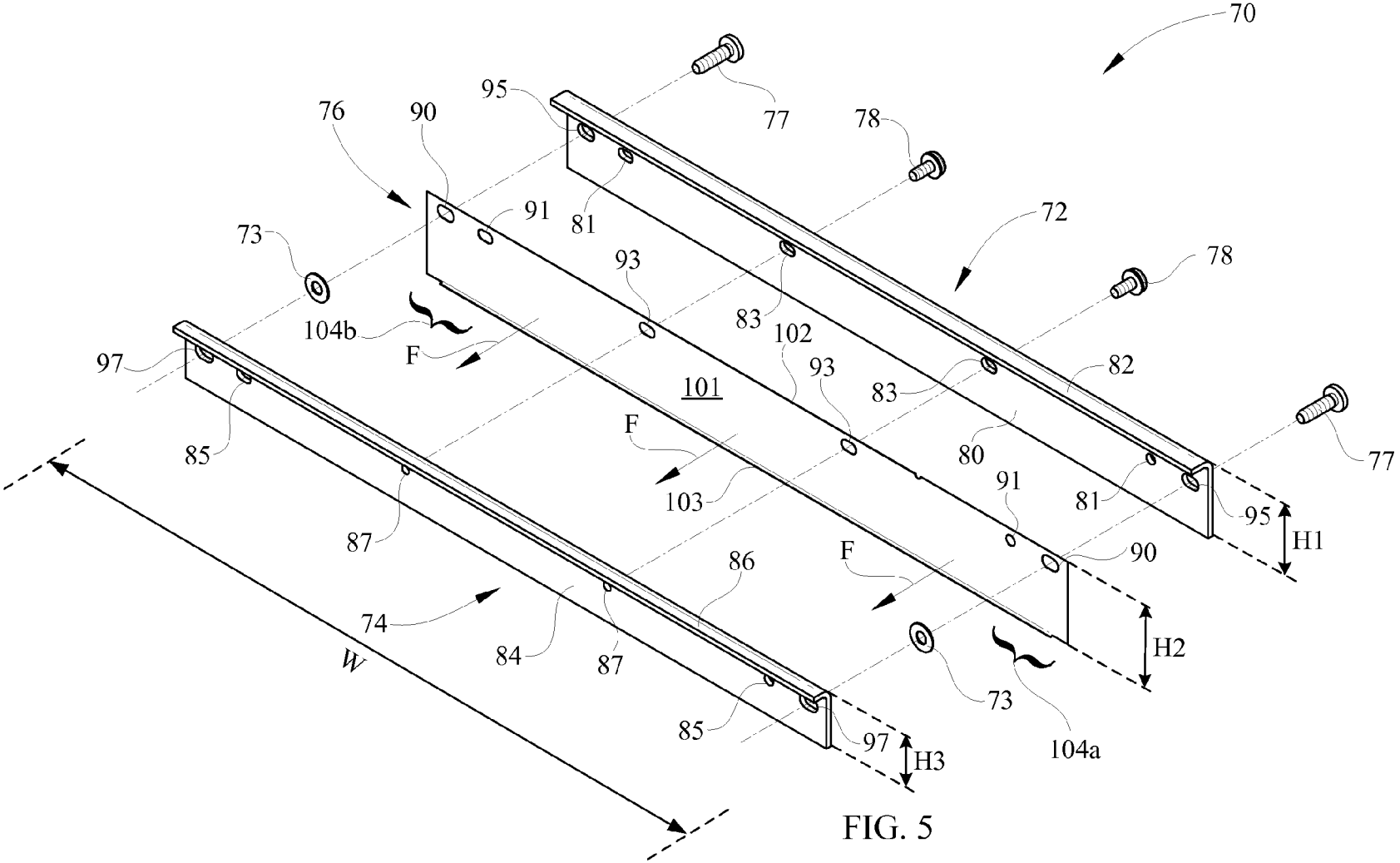
FIG. 5 depicts a rear exploded perspective view of the doctor blade assembly of FIG. 4.

Referring now to FIGS. 4 and 5, the doctor blade assembly 70 is shown in perspective view, from opposite sides. The doctor blade assembly 70 comprises a front bracket 72 having a first leg 80 and a stiffener 82, such as a gusset. The bracket 72 may be formed of various corrosion resistant materials, however the exemplary bracket 72 is formed of zinc coated steel. The first leg 80 and stiffener 82 define a substantially L-shaped bracket. Along the first leg 80 of the bracket 72 are a plurality of apertures. The front bracket 72 is generally defined by a width W and a height H1 defining a substantially rectangular shape of the first leg 80 wherein the width is the long dimension and the height is the shorter dimension of the bracket 72 shown. Adjacent ends of the first leg 80 are apertures 95, which receive assembly mounting fasteners 77. The apertures 95 allow for connection of the assembly 70 to the developer housing 42. The exemplary fasteners 77 are depicted as screws which are utilized to attach the doctor blade assembly 70 to the developer housing 42 which may be the upper housing 42, the lower housing 44 or some position there between as depicted in FIG. 2. Moving inwardly from the distal ends of the first leg 80 toward a central position, locating holes 81 are positioned inwardly from the assembly mounting apertures 95. The locating holes 81 receive pins 89 (FIG. 2) extending from the developer housing to properly locate the doctor blade assembly 70 on the developer assembly 40. Moving inwardly across the width of the first leg 80 from the locating holes 81, are clamping apertures 83. The clamping apertures 83 receive clamping fasteners 78, which connect the front bracket 72 to the doctor blade 76 and the back or rear bracket 74. According to the exemplary embodiment, the clamping fasteners 78 do not connect the doctor blade assembly 70 to the toner housing like the assembly mounting fasteners 77, but instead clamp the assembly components together. The clamping fasteners 78 are also depicted as screws, however the clamping fasteners 78 and the assembly mounting fasteners 77 may be alternative forms of fasteners known to one of ordinary skill in the art.

Figure 6:
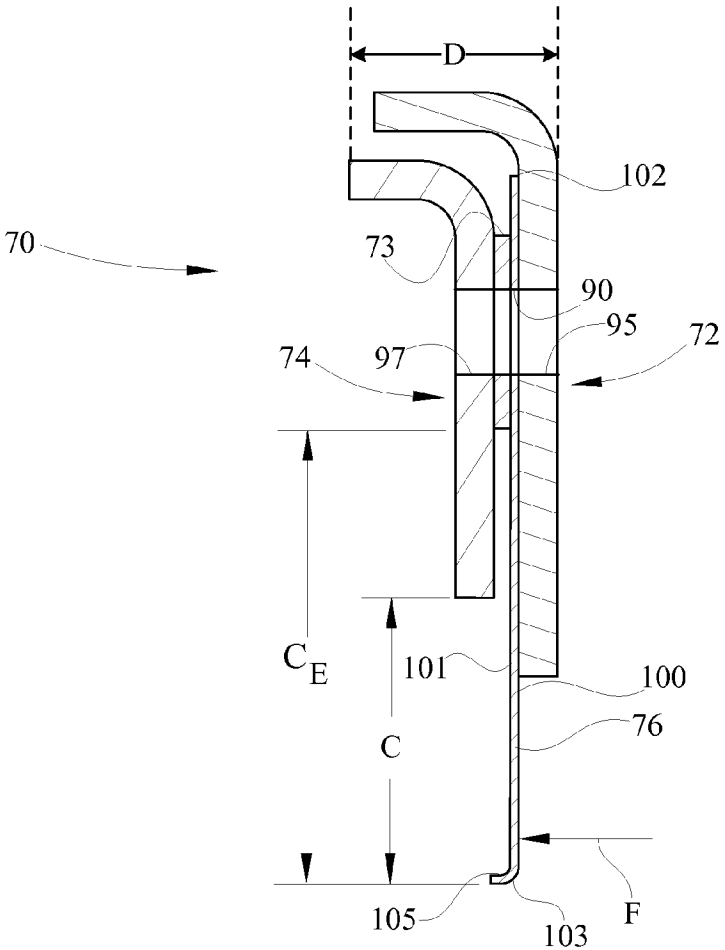
FIG. 6 depicts a side-sectional view of the doctor blade assembly.

Opposing the front bracket 72 is a rear bracket 74 which may be formed of various materials including zinc coated steel. As depicted in FIG. 3, the rear bracket is located closer to the developer housing than the front bracket 72 when the developer assembly 40 is fully assembled. The rear bracket 74 comprises a first leg 84 and a stiffening gusset 86 which is substantially perpendicular to the first leg 84. The first leg 84 also has a width W and a height H3 defining a rectangular shape, wherein the width is the long dimension and the height is the shorter dimension. Adjacent the ends of the first leg 84 are assembly fastener apertures 97. Inwardly therefrom in the direction of the width dimension are locating apertures 85. Continuing inwardly along the width of the bracket 74 are threaded apertures 87 which receive the clamping fasteners 78. The apertures 87, 85 and 97 are substantially aligned with the apertures 83, 81 and 95 respectively of the front bracket 72 so that the front and rear bracket 72, 74 may be fastened together to retain a doctor blade 76 there between. The doctor blade 76 also is substantially rectangular in shape, having a width dimension W and a height dimension H2, wherein the width dimension is the longer dimension and the height dimension is the shorter dimension, as previously described with the front and rear bracket 72, 74. The doctor blade 76 includes a front face 100 and a rear face 101 formed between a top 102 and a bottom 103 of the doctor blade 76 and extending from a first end portion 104*a* of the doctor blade to a second end portion 104*b*. The doctor blade 76 also includes a stiffener 105, such as a gusset (FIG. 6). The doctor blade 76 has assembly fastener apertures 90 at upper ends of the material. Moving inwardly in the width direction toward the middle of the doctor blade 76 are locating apertures 91 which align with the locating apertures 81, 85 of the front and rear bracket 72, 74 respectively. Moving further inwardly along the doctor blade surface are clamping apertures 93, which receive the clamping fasteners 78 passing through the front bracket 72 to the rear bracket 74. The exemplary doctor blade 76 is formed of tempered stainless steel to provide the desirable elasticity while also having corrosion resistance.

Figure 10:
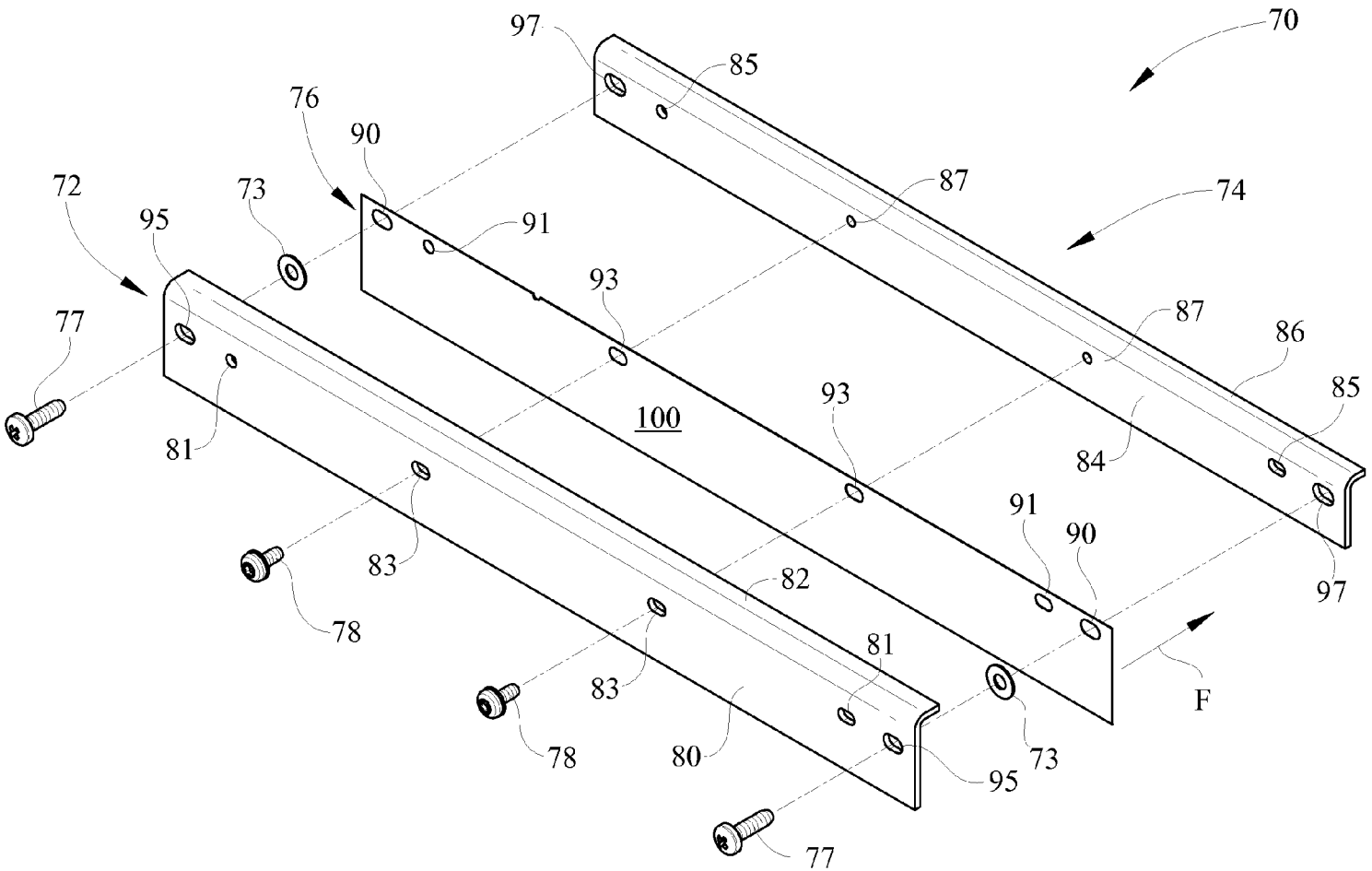
FIG. 10 depicts a front exploded perspective view of a doctor blade assembly according to an embodiment wherein a spacer is disposed between the doctor blade and a front bracket.

Disposed between the doctor blade 76 and the rear bracket 74 are spacers 73. Alternatively, spacers 73 may be positioned between the doctor blade 76 and the front bracket 72 (FIG. 10). These spacers 73 are embodied by washers which are aligned with the apertures 95, 90, 97 and the assembly mounting fasteners 77. The spacers 73 increase the cantilever distance of the doctor blade 76, rendering the doctor blade 76 more flexible near end portions 104*a*, 140*b* thereof which aids in consistent application of toner across the entire width of the developer roll 60 (FIG. 2).

Referring now to FIG. 6, a side-sectional view of the doctor blade assembly 70 is depicted. As shown, doctor blade assembly has a depth D. The fasteners of the assembly 70 are removed for clarity so that the spacer 73 is shown clearly between the doctor blade 76 and rear bracket 74. The rear blade 74 is clearly shown having a height dimension less than the height dimension of the front bracket 72. An arrow F is shown indicating a force F applied on the doctor blade 76 due to the engagement with the developer roll 66 (FIG. 3). With the force F applied in the direction shown, the doctor blade has a cantilever length $C_E$ at ends of the rear bracket 74. The cantilever length $C_E$ is measured from the lower peripheral edge of spacer 73 to the lower edge of the blade 76. Moving inwardly along the width dimension of the doctor blade assembly 70, the washers 73 are not utilized so that the cantilever length of the doctor blade 76 is shown by dimension C, which is measured from the lower edge of the rear bracket 74 to the lower edge of the blade 76. With the longer cantilever length $C_E$ at ends of the assembly 70 as well as the connection of the assembly 70 to the developer housing, the doctor blade 76 is more flexible near those ends which allows for equivalent force across the entire width of the doctor blade 76, and therefore consistent layering of toner across the developer roll 66, rather than the decreased amounts of toner at ends of the developer roll due to the increased stiffness caused by the connections with the developer housing at those ends. The clamping fasteners 78 sandwich the brackets 72,74 and blade 76 so that the rear bracket 74 engages the blade 76 at a position lower than at the ends where spacers 73 are positioned. Thus, in the exemplary embodiment, between fasteners 78, the cantilever length C is substantially the same along this portion of assembly 70.

Figure 7:
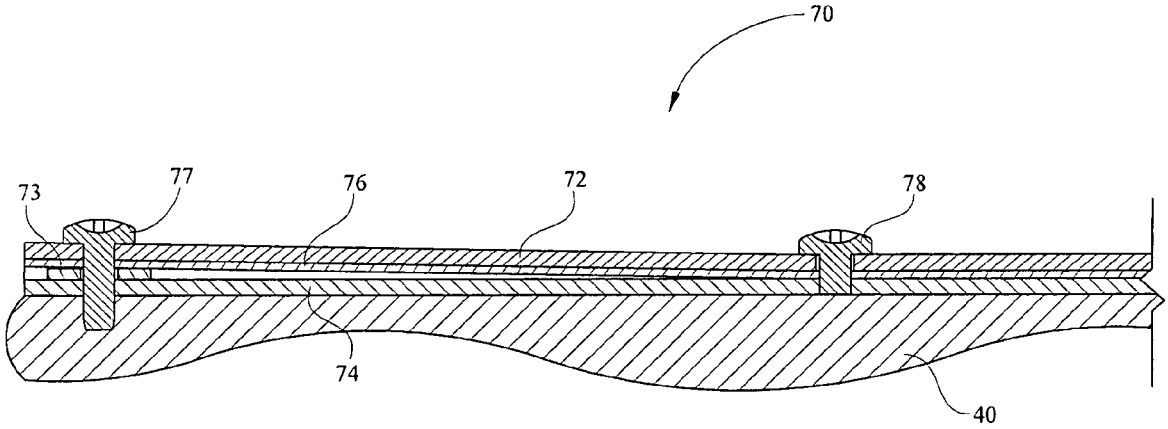
FIG. 7 depicts a bottom sectional view of one-half of the doctor blade assembly.

Referring now to FIG. 7, a bottom section view of a doctor blade assembly 70 is depicted connected to a portion of the housing 42,44. It should be clear that the only half of the doctor blade assembly 70 is depicted, as the structure is substantially symmetrical. The front bracket 72 is depicted engaging fasteners 77 and 78. The front bracket 72 is positioned adjacent to the doctor blade 76, while the rear bracket 74 is disposed adjacent to the doctor blade 76 near the central region of the assembly 70. At the depicted end of the doctor blade assembly 70 around fastener 77, the washer 73 is located between the doctor blade 76 and the rear bracket 74, creating spacing in between. Such spacing increases the cantilever distance from the lowermost edge of doctor blade 76 to a contact point with the doctor blade 76, since the doctor blade 76 is not contacted at the lowermost edge of the rear bracket, but instead at a higher position along the height dimension of the rear bracket 74 at the spacer 73. This distance is marked $C_E$.

Figure 8:
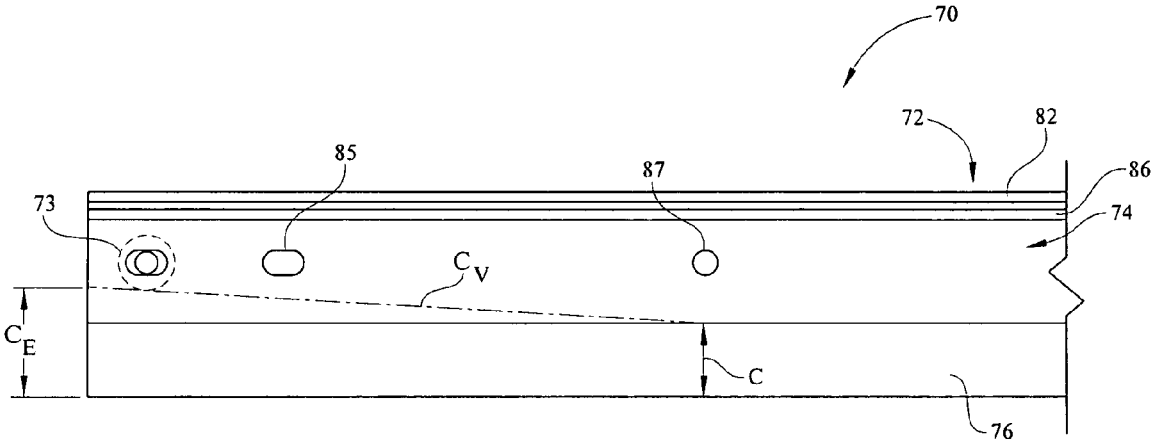
FIG. 8 depicts a rear partial sectional view of the doctor blade assembly.

Referring now to FIG. 8, a rear view of the doctor blade assembly 70 is shown. The doctor blade assembly is again depicted symmetrically cut in half at about the midway point of the width dimension of the doctor blade assembly 70. The view depicts the rear bracket 74 with the upper stiffener 82 of the front bracket 72 disposed above the stiffener 86 of the rear bracket 74. At the left end of the rear bracket 74 a spacer 73, such as a washer, is depicted in broken lines behind the rear bracket 74. Extending centrally from the lower edge of the rear bracket 74 to a tangential position along the outer circumference of spacer 73 is a broken line $C_V$. The line $C_V$ indicates how the cantilever length of the doctor blade 76 varies from the end of the doctor blade assembly 70 to a position beneath the clamping fasteners 78. At an end of the assembly 70, the cantilever length is measured $C_E$. This dimension represents the distance from the lowermost edge of the spacer 73 to the lowermost edge of the doctor blade 76. During operation, and in reference to FIG. 3, one of ordinary skill in the art will understand that the doctor blade 76 will be engaged by the washer 73 at the point labeled $C_E$, and therefore will be cantilevered from that point to the lowermost edge of the doctor blade 76. Thus, the doctor blade 76 is more flexible with a longer cantilever distance when other variables remain constant. Moving inwardly along line $C_V$, the cantilever distance C at the point beneath the clamping screw 78 which would be inserted in opening 87 is less than the cantilever distance $C_E$. This is due to the lowermost edge of the rear bracket 74 contacting the doctor blade 76 at a lower point along the height dimension of the doctor blade than the contact point near the ends of the rear bracket 74, specifically near the spacer 73. Thus, the cantilever distance C is less near the clamping screw 87, and the doctor blade is stiffer in that region than at ends of the assembly 70.

Figure 9:
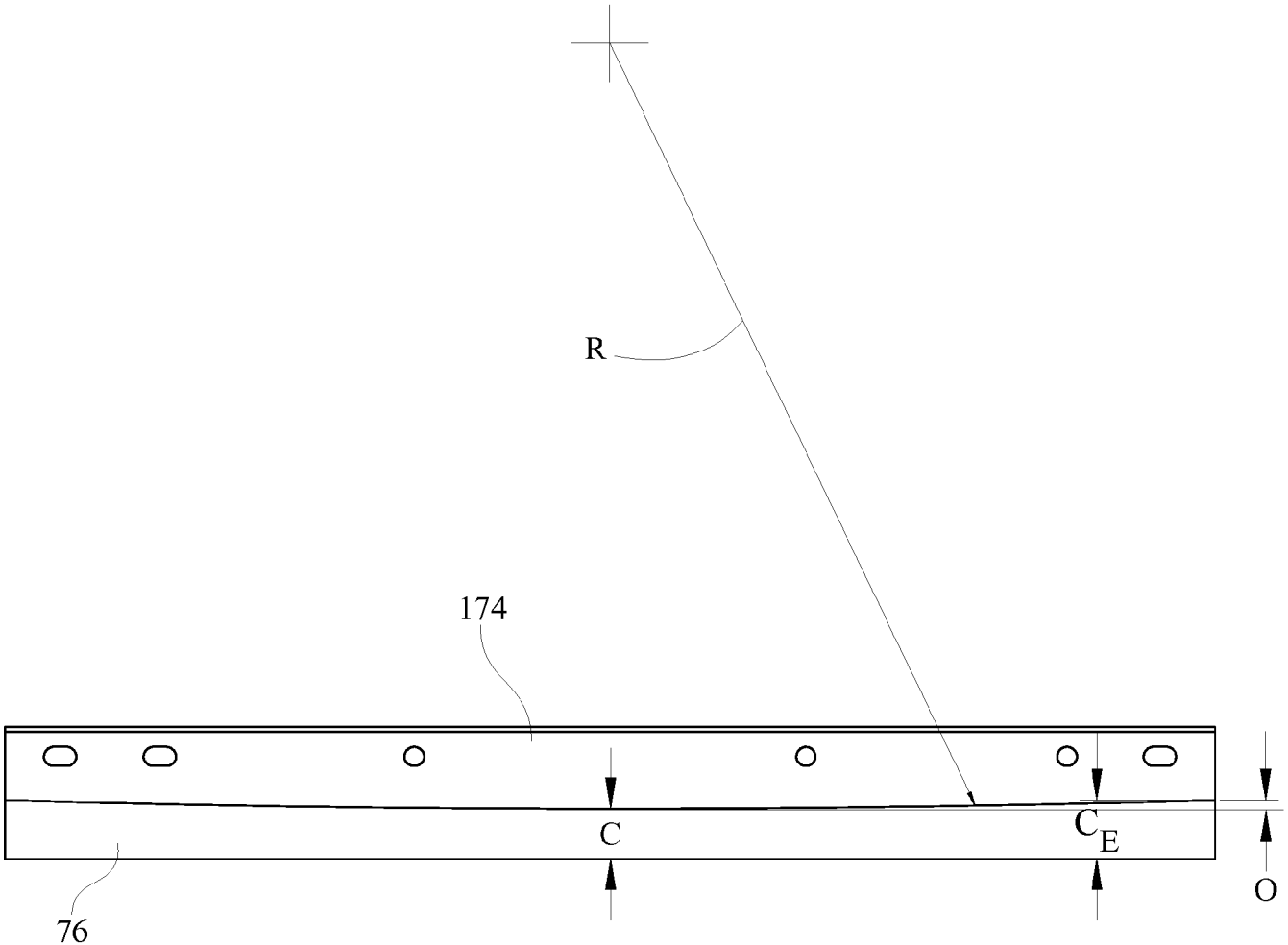
FIG. 9 depicts an alternative bracket for a doctor blade assembly.

Referring now to FIG. 9, an alternative rear bracket 174 is depicted relative to a doctor blade 76. The rear bracket 174 comprises the width and height defining a substantially rectangular shape as previously described, wherein the width dimension is longer than the height dimension of the rear bracket. However, the lowermost edge of the rear bracket 174 has a contoured radius R or curvature which provides that the cantilever length $C_E$ that is greater than the length C at the central portion of the rear bracket 174. Again, this provides a more flexible doctor blade 76 near ends of the rear bracket 174, and a stiffer doctor blade in the middle portions of the rear bracket 174. Accordingly, the force applied by the doctor blade 76 is substantially uniform along the axial length of the developer roll 66. At the right hand side of the bracket 174, an offset distance between the lowermost edge of the rear bracket 174 and the end of the radius portion of the rear bracket 174 is shown as a dimension O. By providing the contoured bracket 174, a more flexible doctor blade is provided near ends of the bracket 174 without requiring the additional spacer element of the previous embodiment. Due to connection of the assembly at ends to the developer housing, the structures described provide more flexibility at ends of the blade 76 and therefore a more uniform force on the developer roll 66.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A doctor blade assembly for an electrophotographic printer, comprising:

a first bracket having a first width dimension and a first height dimension;

a second bracket having a second width dimension and a second height dimension;

a doctor blade disposed between said first bracket and said second bracket; and a spacer disposed near each end portion of said doctor blade between one of (a) a first face of said doctor blade and said first bracket and (b) a second face of said doctor blade and said second bracket, each spacer forming a tapering space between each end portion of said doctor blade and one of said first and second brackets extending toward a center portion between said end portions of said assembly and in said center portion said first face of said doctor blade being in contact with said first bracket and said second face of said doctor blade being in contact with said second bracket, said spacers and said spaces positioning said doctor blade to have a cantilever length that is longer at each of said end portions than in said center portion with said cantilever length decreasing from each end portion to said center portion.

2. A doctor blade assembly, comprising:

a first bracket having a first leg of a first width defined between a first end and a second end;

a second bracket having a second leg having a second width substantially equal to said first width;

a doctor blade disposed between said first bracket and said second bracket, said doctor blade connected to said first bracket and said second bracket near said first and second ends of said first bracket and said second bracket; and a spacer disposed at each of said first and second ends of said first and second brackets and between one of (a) a first face of said doctor blade and said first bracket and (b) a second face of said doctor blade and said second bracket, each of said spacers respectively forming a tapering space extending from each of said first end and said second end toward a center portion of said assembly between said first and second ends and in said center portion said first face of said doctor blade being in contact with said first bracket and said second face of said doctor blade being in contact with said second bracket, said spacers and said spaces positioning said doctor blade to have a cantilever length which is longer near said first and second ends than in said center portion with said cantilever length decreasing from that in each of said first and second ends to that in said center portion between said first and second ends.

3. The doctor blade assembly of claim 2, further comprising a developer housing connected to said doctor blade assembly.

4. The doctor blade assembly of claim 3, further comprising an assembly screw near said first and second ends of said first and second brackets, respectively.

5. The doctor blade assembly of claim 4, wherein said assembly screw connects said doctor blade assembly to said developer housing.

6. The doctor blade assembly of claim 2, further comprising at least one clamping screw connecting said first bracket, said second bracket and said doctor blade.

7. The doctor blade assembly of claim 2, further comprising one of said first face and said second face of said doctor blade receiving an applied force, said spacer being disposed against the other of said first face and said second face of said doctor blade.

8. A doctor blade assembly, comprising:

a first bracket having a width and a height;

a second bracket substantially parallel to said first bracket;

a doctor blade disposed between said first bracket and said second bracket; and a spacer disposed at each of a first and a second end of said first and second brackets and between one of (a) a first face of said doctor blade and said first bracket and (b) a second face of said doctor blade and said second bracket, each of said spacers respectively forming a tapering space extending from each of said first end and said second end toward a center portion of said assembly between said first and second ends and in said center portion said first face of said doctor blade being in contact with said first bracket and said second face of said doctor blade being in contact with said second bracket, said spacers and said spaces positioning said doctor blade to have a tapering cantilever distance between each end of said first bracket that decreases to that in said center portion.

9. The doctor blade assembly of claim 8, wherein said doctor blade assembly engages a developer roll.

10. The doctor blade assembly of claim 8, wherein one of said first face and said second face of the doctor blade is engaged with a developer roll and said spacer is positioned against the other of said first face and said second face of said doctor blade.

11. The doctor blade assembly of claim 8, further comprising assembly fasteners near each end of said doctor blade assembly for connecting said assembly to a developer housing.

12. The doctor blade assembly of claim 11, further comprising at least two spaced apart clamping fasteners positioned inwardly of said assembly fasteners for attaching said first and second brackets and said doctor blade together to form said center portion therebetween.

* * * * *